United States Patent [19]

Kitamura et al.

[11] 3,987,611

[45] Oct. 26, 1976

[54] METHOD AND APPARATUS FOR TAKING UP A YARN ONTO A PIRN AFTER FALSE-TWISTING

[75] Inventors: Shigeo Kitamura; Akira Kageyama, both of Osaki; Toshihiro Kajiura, Takatsuki; Yoshihisa Kubo, Osaka, all of Japan

[73] Assignee: Kanebo, Ltd., Tokyo, Japan

[22] Filed: Sept. 12, 1974

[21] Appl. No.: 505,231

Related U.S. Application Data

[62] Division of Ser. No. 252,278, May 11, 1972, abandoned.

[30] Foreign Application Priority Data

May 14, 1971 Japan ..... 46-32797

[52] U.S. Cl. ..... 57/34 HS; 57/94; 242/18 R; 242/45

[51] Int. Cl.² ..... D02G 1/02

[58] Field of Search ..... 242/18 DD, 18 R, 45; 57/34 HS, 157 TS

[56] References Cited

UNITED STATES PATENTS

| | | | |
|---|---|---|---|
| 3,009,312 | 11/1961 | Seem et al. | 57/34 HS X |
| 3,077,724 | 2/1963 | Stoddard et al. | 57/34 HS |
| 3,329,360 | 7/1967 | Schippers | 242/18 DD |
| 3,831,362 | 8/1974 | Dudzik | 242/18 DD X |
| 3,839,853 | 10/1974 | McKenzie | 57/34 HS |

*Primary Examiner*—Stanley N. Gilreath
*Attorney, Agent, or Firm*—Malcson, Kimmelman and Ratner

[57] ABSTRACT

Percent take-up feed of a yarn, which is taken up onto a pirn by rotary surface contact with a take-up roller via delivery rollers, is time-functionally and continuously changed by a speed converter which is inserted into a rotation transmission mechanism between both rollers and whose speed conversion ratio is adjusted by a pilot shaft in accordance with a programme which is designed on the basis of the take-up feed characteristic curve in order to obtain a yarn of uniform stretch property, the characteristic curve being in practice approximated by a combination of three or fewer straight lines.

12 Claims, 21 Drawing Figures

METHOD AND APPARATUS FOR TAKING UP A YARN ONTO A PIRN AFTER FALSE-TWISTING

Figure 1:
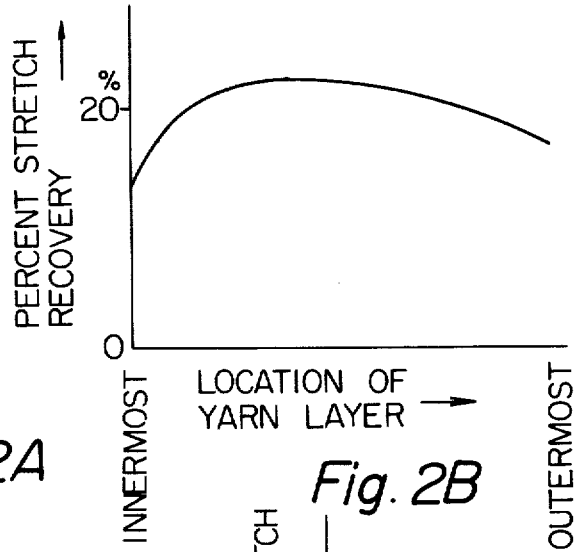

This is a division of application Ser. No. 252,278, filed May 11, 1972, now abandoned.

The present invention relates to improved method and apparatus for taking up a yarn onto a pirn after false-twisting, more particularly relates to method and apparatus for taking up a yarn onto a pirn after false-twisting at percent take-up feed which is time-functionally and continuously changed following a predesigned programme during the growth of the pirn.

It is known in general that, when a pirn of a false-twisted yarn is subjected to a thermal treatment or treatments in a later stage or stages, the yarn composing the pirn tends to shrink due to the liberation of strains once imposed to the fibers forming the yarn in a preceding operational stage or stages. Such shrinkage of the yarn composing the pirn exerts compression force on yarn layers in the pirn configuration. Such compression force is accumulated from outer to inner portions of the pirn configuration and the innermost yarn layer is placed under a great deal of compression by such accumulated compression force. The stretchability and the stretch recovery of the yarn of the pirn may be ill influenced by such accumulated compression caused by the thermal treatment applied to the pirn. Because the extent of accumulation of the compression force varies from layer to layer, the yarn delivered from such pirn is provided with undesirable variations in the stretchability and stretch recovery along the length thereof. In general, yarn portions from the inner layers of the pirn are provided with low stretchability and stretch recovery, yarn portions from the intermediate layers are provided and high stretchability and stretch recovery and yarn portions from the outer layers are provided with relatively low stretchability and stretch recovery.

The conventional arrangement for taking up a yarn onto a pirn after false-twisting generally comprises a pair of cooperating delivery rollers positioned downstream of the false-twisting spindle and a take-up roller spaced downstreamly from the delivery rollers. The pirn is built through a rotary surface contact thereof with the take-up roller.

The term "percent take-up feed" used in this specification refers to the value defined by the following formula;

$$\frac{V_7 - V_8}{V_7} \times 100$$

wherein $V_7$: Surface speed of the delivery rollers.

$V_8$: Surface speed of the take-up roller.

The term "percent stretch recovery" used in this specification refers to the value defined by the following formula;

$$\frac{L_1 - L_2}{L_1} \times 100$$

wherein $L_1$: Length of yarn under 100 mg/denier loading after 30 minutes treatment in boiling water of 100° C.

$L_2$: Length of yarn under 2 mg/denier loading thereafter.

The term "reference stretch recovery characteristic curve" used in this specification refers to a curve showing the relationship between the percent stretch recovery and the location of the yarn layers in the configuration of a thermally treated pirn, which has been built by taking up the yarn at a constant percent take-up feed.

Several measures have been proposed in order to eliminate or mitigate the ill influence on the yarn stretch property caused by such application of thermal treatment. In one system, the bobbin carrying the pirn is replaced by the other bobbin of smaller diameter prior to the thermal treatment whereas, in the other system, the pirn itself is made shiftable in the diameter thereof. By employment of such conventionally known measures, stretch property of the yarn portions from the inner and intermediate layers may be improved to an appreciable extent but that of the yarn portion from the outer layers cannot be sufficiently improved thereby.

Especially in the case of the compression dyeing system which is recently in fashion in this industry, the pirn inserted over a spindle of the dyeing machine is axially flattened by compression. The above-mentioned trouble regarding the yarn portions from the outer layers will be further enlarged by the increased diameter of the axially compressed pirn.

As a result of repeated experiments, it was confirmed by the inventors of the present invention that the value of percent stretch recovery of the false-twisted yarn after the thermal treatment is greatly influenced by the value of percent take-up feed of the yarn after false-twisting. In other word, the value of percent stretch recovery of the false-twisted yarn after the thermal treatment can be controlled as desired by adjusting the value of percent take-up feed of the yarn after false-twisting.

The principal object of the present invention is to provide improved method and apparatus productive of false-twisted yarns having uniform stretch property along the length thereof regardless of the location of the yarn layers in the pirn configuration.

In order to attain the above-described object in the system of the present invention, a programme is designed on the basis of a take-up feed characteristic curve having a pattern in reverse to that of the reference stretch recovery characteristic curve of the yarn. A speed converter is inserted into the rotation transmission mechanism between the take-up roller and the delivery rollers and the speed conversion ratio of this speed converter is time-functionally and continuously changed by a rotary pilot shaft connected thereto whose rotation is controlled by a driving mechanism following the above-described programme. By this change of the speed conversion ratio, the value of percent take-up feed is changed accordingly.

Figure 2A:
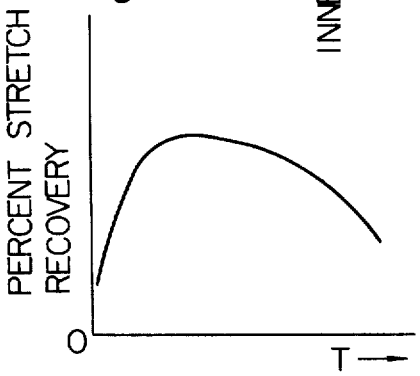
Figure 2B:
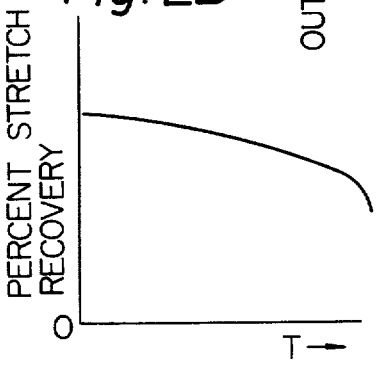
Figure 3A:
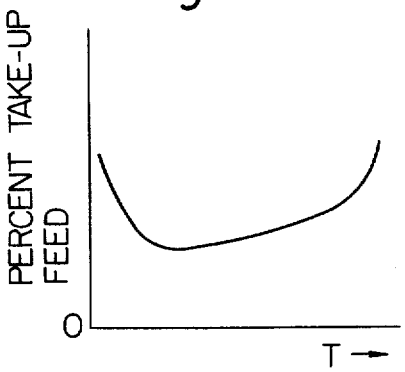
Figure 3B:
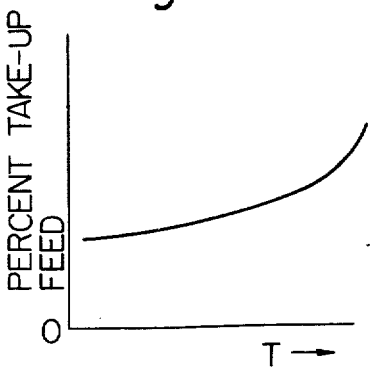
Figure 4A:
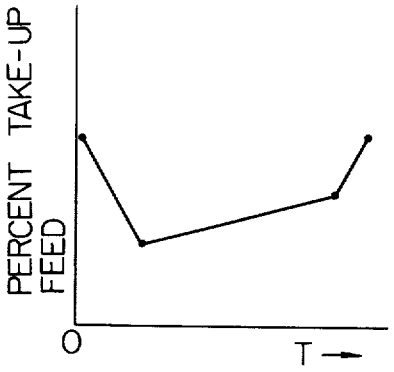
Figure 4B:
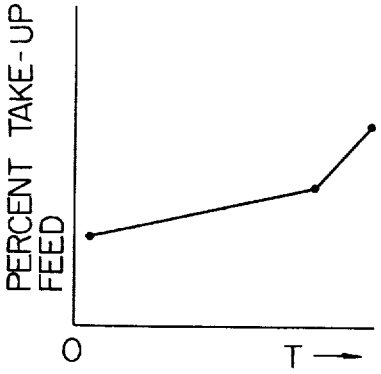
Figure 5:
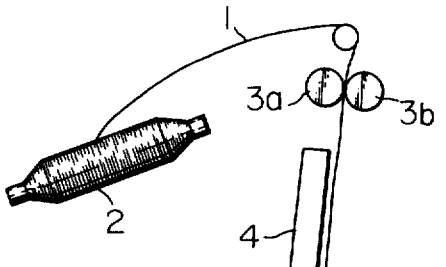
Figure 6:
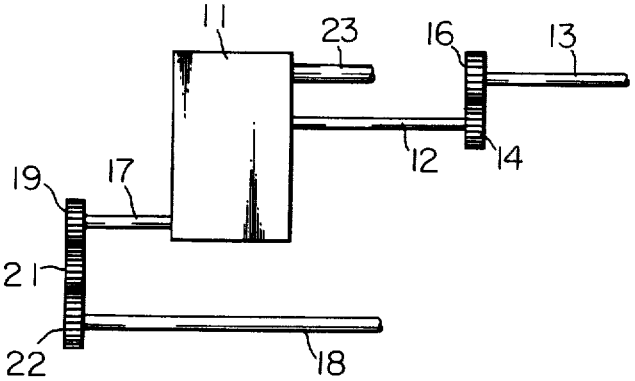
Figure 7A:
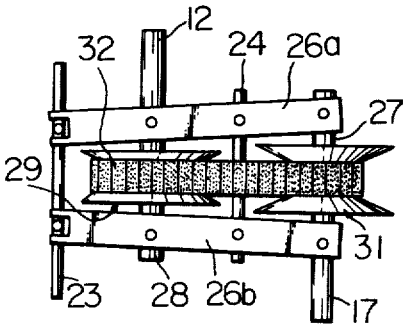
Figure 7B:
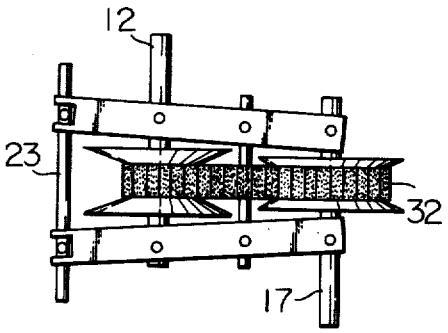
Figure 8:
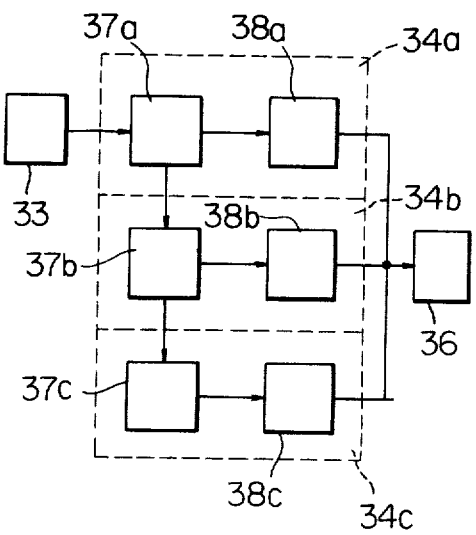
Figure 9:
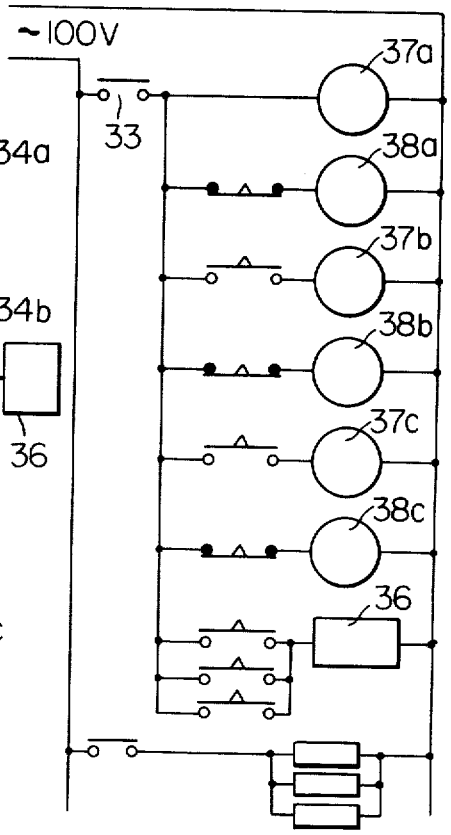
Figure 10:
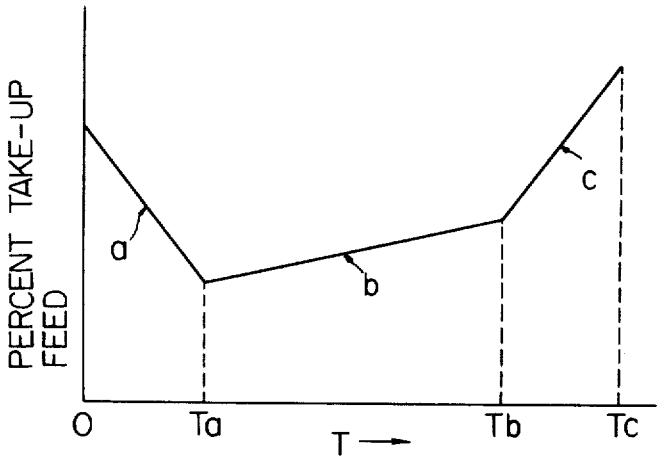
Figure 11:
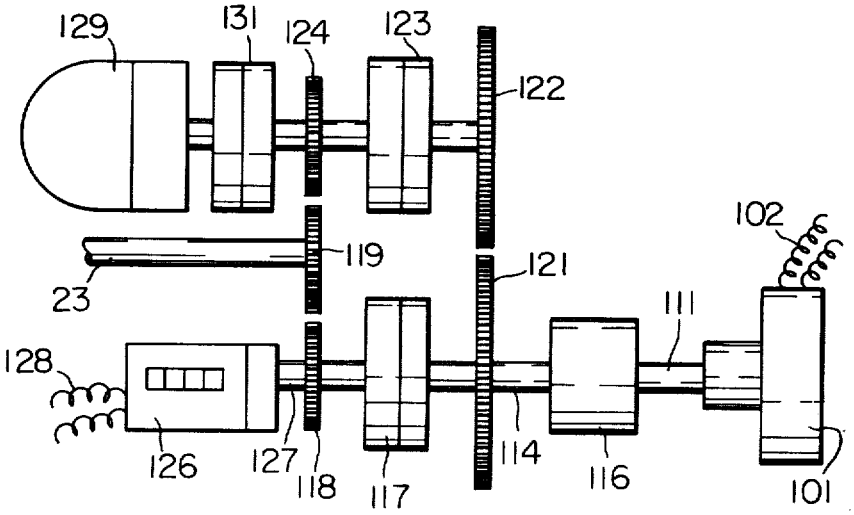
Figure 12:
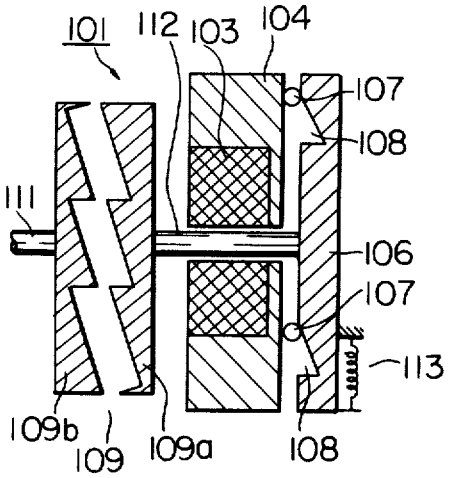
Figure 13:
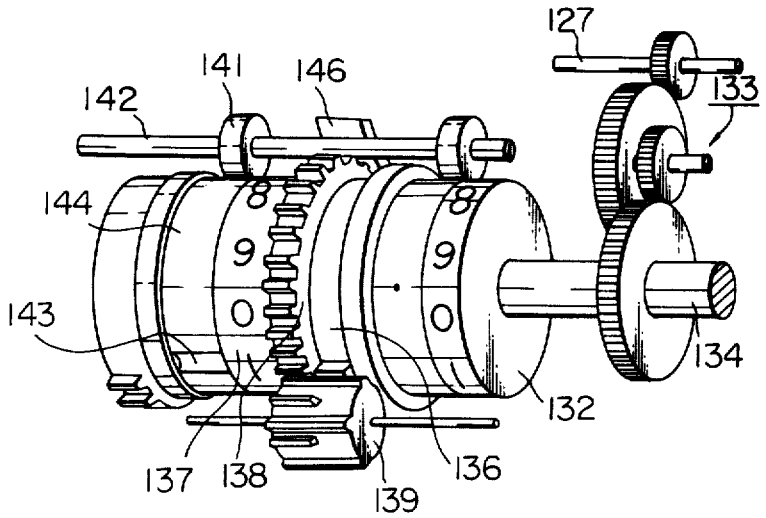

Further features and advantages of the present invention may be made clearer in the ensuing description, reference being made to the accompanying drawings, in which;

FIG. 1 is a graphical drawing for showing a typical stretch recovery characteristic curve of a false-twisted yarn after thermal treatment, FIGS. 2A and 2B are graphical drawings for showing two typical patterns of stretch recovery characteristic curve of false-twisted yarns after thermal treatment, FIGS. 3A and 3B are graphical drawings for showing take-up feed characteristic curves designed in reverse to the curves shown in FIGS. 2A and 2B, respectively, FIGS. 4A and 4B are graphical drawings for showing combinations of straight lines approximating the take-up feed characteristic curves shown in FIGS. 3A and 3B, respectively, FIG. 5 is a schematic side view of a false-twisting system to which the present invention is applied, FIG. 6 is a schematic explanatory view of the apparatus of the present invention, FIGS. 7A and 7B are schematic top plane views of the construction of the speed converter used in the apparatus shown in FIG. 6, FIG. 8 is a block diagram for showing the driving mechanism of the speed converter shown in FIGS. 7A and 7B, FIG. 9 is an electric circuit diagram of the mechanism shown in FIG. 8, FIG. 10 is a graphical drawing used for explaining the method of the present invention, FIG. 11 is a schematic sketch of the mechanism for driving and resetting the speed converter, FIG. 12 is a partly sectional view of the rotating mechanism used in the arrangement shown in FIG. 11, FIG. 13 is a simplified perspective plane view of the auto-counter used in the arrangement shown in FIG. 11, FIGS. 14 to 17 are graphical drawings used for explaining the examples described in the specification.

As already mentioned in the foregoing descriptions, the concept of the present invention is on the basis of the analysis of the reference stretch recovery characteristic curve of the yarn to be processed.

Referring to FIG. 1, a typical relationship between the percent stretch recovery taken on the ordinate and the location of the yarn layers in the pirn configuration taken on the abscissa is shown. The location of the yarn layers may be represented in terms of the time length after starting of the yarn take up onto the pirn. In this case, the yarn is taken up at a constant percent take-up feed and the percent stretch recovery is measured after application of the thermal treatment. It will be clearly seen in the drawing that the percent stretch recovery increases as the yarn layer increases in distance from the core of the pirn and, beyond a certain location of the yarn layer, decreases gradually as the yarn layer approaches the outermost surface. In other words, the characteristic curve has an upwardly convex pattern.

As is clear from the experimental results shown in FIG. 1, there is a very close relationship between the location of the yarn layers in the pirn configuration and the percent stretch recovery after application of the thermal treatment. In this connection, many analysis of the stretch recovery characteristics have been conducted by the inventors of the present invention regarding textile pirns of a wide variety and it was confirmed by them that the stretch recovery characteristic curves of various textile pirns can be roughly classified into two typical groups.

The characteristic curves of the first group assume the pattern shown in FIG. 2A and are obtained when the pirn per se is directly subjected to the thermal treatment after building thereof, the form being upwardly convex. The characteristic curves of the second group assume the pattern shown in FIG. 2B and are obtained when the bobbin of the pirn is replaced by a new bobbin of smaller diameter after building thereof and, thereafter, the pirn is subjected to the thermal treatment in an axially compressed condition, the curve sloping down from the inner towards the outermost layer. In both cases, instead of the location of the yarn layer the time length (T) after starting of the yarn take-up onto the pirn is taken on the abscissa.

According to the concept of the present invention, the percent take-up feed should be so designed that the take-up feed characteristic curve assumes a pattern in reverse of the pattern of the stretch recovery characteristic curve. For both groups shown in FIGS. 2A and 2B, such take-up feed characteristic curves are shown in FIGS. 3A and 3B, respectively. In other words, the percent take-up feed must be continuously changed during the take-up operation following the programme represented by the characteristic curve such as shown in FIG. 3A or 3B.

It was further confirmed by the inventors of the present invention that, in the practical utilization of the present invention on the commercial scale, the take-up feed characteristic curve so obtained may be approximated by a combination of three or fewer straight lines. Typical examples of such approximation are shown in FIGS. 4A and 4B, respectively. By employment of such approximation, the construction of the mechanism for time-functionally changing the percent take-up feed can be remarkably simplified with a desirable reduction in the manufacturing cost.

Referring to FIG. 5, there is shown a false-twisting system to which the concept of the present invention is applied. A yarn 1 issuing from a supply cop 2 is subjected to thermal treatment by a heater 4 via a pair of feed rollers 3*a* and 3*b* and is next false-twisted by a false-twisting spindle 6 located downstream of the heater 4. After false-twisting, the yarn is taken up onto a pirn 9 on a take-up roller 8 after passing through the nip, by a pair of delivery rollers 7 located between the false-twisting spindle 6 and the take-up roller 8.

In order to change the percent take-up feed, there are three possibilities. In the first case, the rotation speed of the delivery rollers 7 is kept constant and that of the take-up roller 8 is changed. In the second case, the rotation speed of the delivery rollers 7 is changed and that of the take-up roller 8 is kept constant. In the third case, both are changed concurrently. However, in the practical working of the present invention, the first system is generally desirably adopted, i.e. the delivery rollers 7 are connected to the input terminal of the later described speed converter (not shown) of the apparatus of the present invention and the take-up roller 8 is connected to the output terminal of same. With this arrangement, the delivery rollers 7 are rotated at constant speed throughout the operation whereas the rotation speed of the take-up roller 8 is time-functionally changed by the speed converter following the programme which is designed in reference to the take-up feed characteristic curve as shown in FIG. 4A or 4B.

A basic embodiment of the apparatus of the present invention is shown in FIG. 6, wherein a speed converter 11 is provided with an input shaft 12 and an output shaft 17. The input shaft 12 is connected to a rotary shaft 13 of one of the delivery rollers 7 via gears 14 and 16 whereas the output shaft 17 is connected to the drive shaft 18 of the take-up roller 8 via gears 19, 21 and 22. The speed converter 11 is further provided with a pilot shaft 23 for adjusting the speed conversion ratio of the speed converter 11. The pilot shaft 23 is linked to a driving mechanism thereof (not shown) which will be explained later in detail. Rotation of the pilot shaft 23 causes a change in the speed conversion ratio of the speed converter 11 and the rotary speed transmission ratio from the input shaft 12 to the output shaft 17 changes accordingly. Owing to this, the rotation speed of the take-up roller 8 is changed while the delivery rollers 7 are rotated at constant speed and, accordingly, the percent take-up feed is changed also.

A typical embodiment of the construction of the speed converter 11 is shown in FIGS. 7A and 7B. The speed converter 11 is internally provided with a fixed shaft 24 and a pair of operator arms 26*a* and 26*b* pivotally mounted on the fixed shaft 24 at about their midpoint. The operator arms 26*a* and 26*b* are connected to the pilot shaft 23 in the manner later described at their one ends. At their other ends, the operator arm 26*b* is pivotally linked to the output shaft 17 and the operator arm 26*a* is pivotally linked to a first auxiliary shaft 27 disposed in an axial alignment with the output shaft 17. At a point midway between the fixed shaft 24 and the pilot shaft 23, the operator arm 26*a* is pivotally connected to the input shaft 12 and the operator arm 26*b* is pivotally connected to a second auxiliary shaft 28 disposed in an axial alignment with the input shaft 12. The speed converter 11 is further provided with two sets of bevel chain wheel assemblies 29 and 31 connected to each other by an endless chain 32. The bevel chain wheel assembly 29 is made up of a pair of toothed facing discs, one being fixedly mounted on the input shaft 12 and the other being fixedly mounted on the second auxiliary shaft 28. The bevel chain wheel assembly 31 is made up of a pair of toothed facing discs, one being fixedly mounted on the output shaft 17 and the other being fixedly mounted on the first auxiliary shaft 31. The shafts 12, 17, 27 and 28 are supported inside the housing (not shown) of the speed converter 11 in an arrangements axially slidable to some extent. The endless chain 32 circulates in meshing engagement with the toothed faces of the discs of the bevel chain wheel assemblies 29 and 31. The operator arms 26*a* and 26*b* are so connected to the pilot shaft 23 that axial rotation of the pilot shaft 23 causes swinging of the operator arms 26*a* and 26*b* about the pivotal points on the fixed shaft 24. The connection is further so designed that the connected ends of the operator arms 26*a*, 26*b* approach each other when the pilot shaft 23 is rotated in one direction whereas they separate from each other when the pilot shaft 23 is rotated in the other direction.

In the disposition shown in FIG. 7A, the rotation speed of the output shaft 17 is greater than that of the input shaft 12 whereas, in the disposition shown in FIG. 7B, the rotation speed of the output shaft 17 is smaller than that of the input shaft.

In the employment of the speed converter 11 of this construction, it must be noted that the change in the speed conversion ratio characteristic of the speed converter 11 is not always linearly proportional to the change in the total number of revolutions of the pilot shaft 23. It is not an absolute requirement in the present invention to select the speed conversion ratio so as to lie only within the area of the linear portion but, in the practical utilization of the present invention on a commercial scale, it is preferable to select the speed conversion ratio to lie only within the area of the linear portion. Usually, the value of the percent take-up feed in the false-twisting process is in a range from 5 to 30% and most of the ordinary speed converters can operate within the linear portion in the range of such percent take-up feed.

As already mentioned, the pilot shaft 23 is connected to a driving mechanism for causing the rotation of same in accordance with a time-functional programme which is designed in reference to the take-up feed characteristic curve such as shown in FIGS. 4A and 4B.

Referring to FIGS. 8 and 9, an embodiment of such driving mechanism of the pilot shaft 23 is shown. As already described, the take-up feed characteristic curve can be approximated by a combination of three or fewer straight lines. Therefore, if the driving mechanism is provided with three operational parts, each of which is responsible for each straight line, the change in the percent take-up feed can be fairly and perfectly carried out by the apparatus of the present invention throughout the whole cycle of the yarn taking up operation in the false-twisting process. The embodiment shown in FIG. 8 is provided with a starting signal generator 33, three operational parts 34*a*, 34*b* and 34*c* connected to the starting signal generator 33 and a relay 36 connected to the three parts 34*a*, 34*b* and 34*c* and to the rotating mechanism (not shown) of the pilot shaft 23. The first operational part 34*a* includes a time-limit timer 37*a* and a pulse generator 38*a* connected to the former. Constructions of the other operational parts 34*b* and 34*c* are quite the same as that of the first operational part 34*a*. The construction of the elements shown by square blocks in FIG. 8 is shown in Further detail in FIG. 9, wherein SYS-R type timers are used for the timers 37*a*, 37*b* and 37*c* and SYS-RP type timers are used for the generators 38*a*, 38*b* and 38*c*. In the case of the SYS-R type timer, the clutch coil performs a time limit operation when not excited and the clutch opens upon excitation. The SYS-RP type timer includes, in addition to the timer mechanism, a delay CR circuit and is capable of performing repeated operations.

In order to explain the operational mode of the pilot shaft driving mechanism, it is firstly assumed that the percent take-up feed is to be changed according to the approximate characteristic curve shown in FIG. 10, wherein the approximate curve is composed of three straight lines *a*, *b* and *c*.

In operation, the operational part 34*a* comes into operation first and the timer 37*a* is set at time T*a*. Upon starting of the take-up operation in the system shown in FIG. 5, the generator 33 issues a starting signal which excites the pulse generator 38*a* for production of the pulse signals. Receiving the pulse signals so produced, the relay 36 actuates the rotating mechanism of the pilot shaft 23. At the moment T*a*, the timer 37*a* stops and this induces the starting of the second timer 37*b*, the second pulse generator 38*b* is started thereby for production of pulse signals and the relay 36 actuates the rotating mechanism of the pilot shaft 23 upon receipt of the pulse signals so produced. At the moment, T*b*, the timer 37*b* stops and the third timer 37*c* starts its operation upon stoppage of the former. Now the third generator 38*c* starts to produce its own pulse signals which actuates the relay 36.

In the above-described system for controling the rotation of the pilot shaft 23, the difference in the distance between the neighbouring pulse signals issued from the generators corresponds to the difference in the inclination of the lines *a*, *b* and *c* composing the approximate take-up feed characteristic curve. When the distance is small, i.e. large number of pulse signals are produced per a unit time, the rotating mechanism imparts a large number of revolution to the pilot shaft 23 and the speed conversion ratio changes greatly. On the contrary, when the distance is large, i.e. a small number of pulse signals are produced per unit time, the rotating mechanism imparts a small number of rotation to the pilot shaft 23 and the speed conversion ratio changes little.

So that the apparatus of the present invention can have a wide, universal application to the textile industry, it is desirable that the timers and pulse generators used in the circuit shown in FIG. 9 are adjustable in their operation.

As the rotating mechanism of the pilot shaft 23, any known pulse motor can be used in the present invention, for rotating the pilot shaft 23 upon receipt of the pulse signals via the relay 36. In this case, the difference in the direction of inclination of the straight lines *a*, *b* and *c* shown in FIG. 10 is interpretted as corresponding to the difference in the polarity of the pulse signals produced by the pulse generators 38*a*, 38*b* and 38*c* and such shift in the polarity of the pulse signals causes a corresponding shift in the direction of rotation which is imparted to the pilot shaft 23 by the rotating mechanism. For example, the pilot shaft 23 rotates in one direction until the moment T*a* and in the other direction after the moment T*a*.

Another embodiment of the mechanism for driving the pilot shaft 23 is shown in FIG. 11, wherein the rotating mechanism 101 of the pilot shaft 23 is electrically connected to the pulse generator as shown in FIG. 9 via electric connection 102. The rotating mechanism 101 is a combination of known rotary solenoid and ratchet mechanisms and the detail of its construction is shown in FIG. 12, wherein the rotating mechanism 101 includes an electric magnet 103 disposed in a casing 104, a movable disc 106 facing the casing 104 via balls 107. The disc 106 is provided with recesses 108 for the balls 107 and the depth of the recess 108 increases in the direction of the rolling of the ball. The movable disc 106 is connected to one disc 109*a* of the ratchet mechanism 109 by a shaft 112 extending freely through the central aperture of the magnet 103. The other disc 109*b* of the ratchet mechanism 109 is connected to the output shaft 111 of the rotating mechanism 101. A return spring 113 is disposed to the movable disc 106.

At the beginning of the operation, the balls 107 are located at the shallowest terminal of the corresponding recesses 108 and the magnet 103 is excited. By this excitation, the movable disc 106 is attracted towards the casing 104 and the balls 107 start to roll owing to the couple forces caused by the attraction of the disc 106 and such rolling of the balls 107 induces axial turning of the disc 106 overcoming the force of the spring 113. When the magnet is deenergized, the disc 106 assumes its original angular position due to the force of the spring 113. This two directional turning movement of the disc 106 is converted into intermittent monodirectional rotation of the output shaft 111 via the ratchet mechanism 109. Every time the rotating mechanism 101 receives the pulse signals produced by the pulse generator, the output shaft 111 of the rotating mechanism 101 rotates in pulsed steps through a definite angle. In other words, the angle of rotation of the output shaft 111 is proportional to the number of pulse signals given to the rotating mechanism 101 at that moment. This rotation of the shaft 111 is transmitted to the other shaft 114 via a reduction gear mechanism 116. In case the value of percent take-up feed should be increased, this rotation of the shaft 114 is transmitted to the pilot shaft 23 via a clutch 117, a gear 118 and a gear 119 fixedly mounted on the pilot shaft 23. On the contrary, if the value of percent take-up feed should be decreased, this rotation of the shaft 114 is transmitted to the pilot shaft 23 also via a gear 121 fixedly mounted on the shaft 114, a gear 122, a clutch 123, a gear 124 and the gear 119.

An auto-counter 126 is connected to a shaft 127 carrying the gear 118 and the output side disc of the clutch 117. The auto-counter 126 is provided with an internal electric contact (not shown) which closes when the actual total number of revolutions counted by the counter 126 coincides with the reference total number of revolutions preliminarily registered in the counter 126. The signal generated by this closure of the internal electric contact is picked up by an electric connection 128.

Utilizing the function of this auto-counter 126, resetting of the mechanism for driving the pilot shaft 23 is carried out in the following sequence. At the beginning of the operation, both the first indicator for the actual total number of revolutions and the second indicator for the reference total number of revolutions are set to a certain identical value, e.g. 5,000. With development of the yarn taking up operation, the number on the first indicator decreases gradually from the initial value so set and, at the end of the operation, the number on the first indicator is quite different from the number (i.e. 5,000) on the second indicator. Due to this inconsistency, a motor 129 starts to rotate, the clutch 131 closes and, via the gears 124 and 119, the pilot shaft 23 is rotated back to its initial angular position. This reverse rotation of the pilot shaft 23 is counted by the auto-counter 126 via the gears 119, 118 and the shaft 127 and, when the accumulated number of revolutions reaches a value equal to the reference total number of revolutions registered in the counter 126, the internal contact of the counter 126 is closed and the signal caused thereby is used for stopping the rotation of the motor 129 and opening the clutch 131.

One embodiment of the construction of the auto-counter 126 is shown in FIG. 13, wherein the rotation of the shaft 127 is transmitted to the first counter band 132 via a reduction gear mechanism 133 and a main shaft 134. A partial gear 136 is attached to the first counter band 132 and the second counter band 137 is accompanied by a gear 138. A pinion 139 is disposed in meshing engagement with the partial gear 136 and the gear 138 attached to the second counter band 137. At every ten count of the first counter band 132, the second counter band 137 is registered with one count via the pinion 139 and the gear 138. When the accumulated number of counts reaches the initially registered reference count, a roller 141 carried by a shaft 142 falls into a groove 143 formed on the periphery of the drum 144 attached to the counter band 137 so as to close the electric contact connected to the shaft 142. A spring 146 is disposed so as to press the roller 141 towards the drum 144 via the shaft 142.

The following examples are illustrative of the present invention, but are not to be construed as limiting same in any way.

EXAMPLE 1

A nylon filament yarn of 75 denier thickness and including 18 filaments was subjected to the false-twisting operation and, after the false-twisting, was taken up constantly at a 10% take-up feed as shown in FIG. 5.

Figure 14:
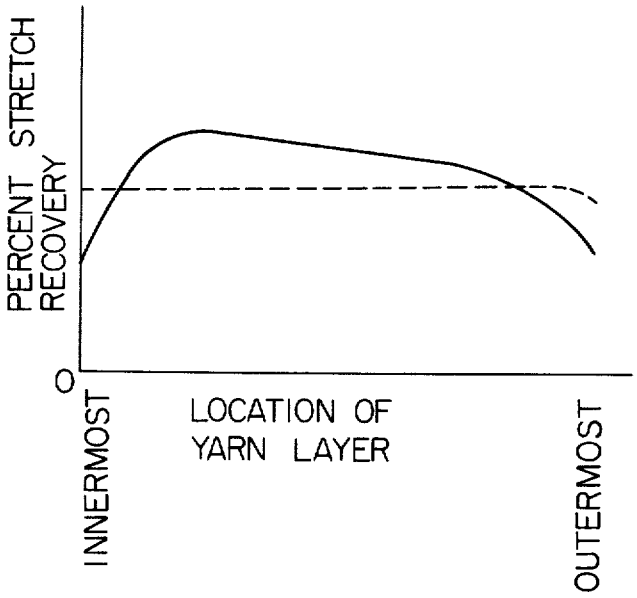
Figure 15:
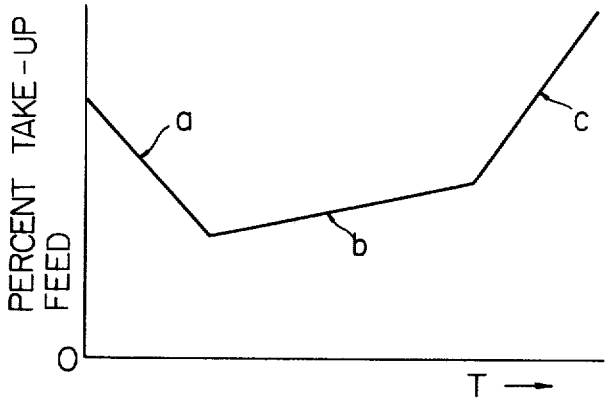

The percent feed in the zone between the feed rollers 3a, 3b and the delivery rollers 7 was 2, the temperature of the heater 4 was maintained at 180° C and the number of false-twists was 3,300 TPM. After the false-twisting operation, the pirn obtained was placed within a steam setter for thermal treatment at 110° C for 30 minutes. With the pirn so prepared, a reference stretch recovery characteristic curve as shown in FIG. 14 was obtained and, on the basis of this characteristic curve, an approximate take-up feed characteristic curve as shown in FIG. 15 was designed in order to change the percent take-up feed following the programme represented by this approximate characteristic curve.

On the basis of this programme, the apparatus of the present invention was adjusted as shown in table 1 below and the yarn was processed through the false-twisting system so adjusted according to the concept of the present invention. After the false-twisting, the pirn so obtained was thermally treated under conditions the same as the above. The stretch characteristic curve of the yarn after the thermal treatment is shown by the dotted line in FIG. 14. From this observation, it is clear that the yarn obtained according to the present invention is provided with uniform stretch recovery from the inner to the outer portion of the pirn configuration.

Table 1

| Period | a | b | c |
|---|---|---|---|
| Length in hr. | 5 | 10 | 5 |
| Distance between neighbouring pulses in sec. | 100 | 250 | 180 |
| Polarity of the pulses | − | + | + |
| Initial percent take-up feed | | 20 | |
| Wound mass of the yarn in gr. | | 500 | |

EXAMPLE 2

Figure 16:
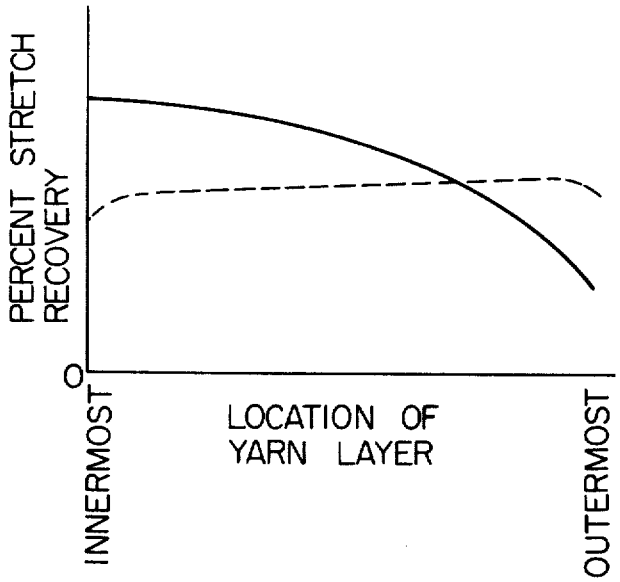
Figure 17:
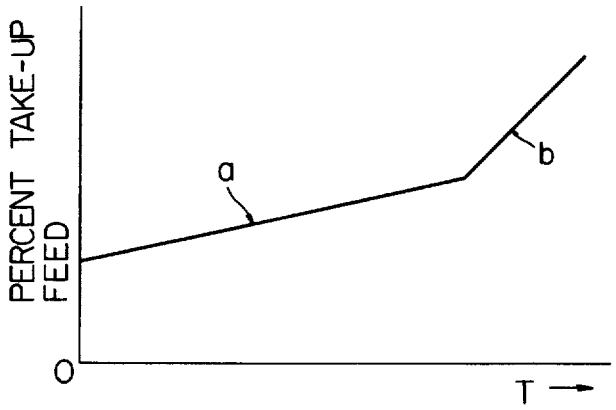

A polyester filament yarn of 150 denier thickness including 32 filaments was false-twisted and taken up in the form of a pirn on a bobbin of 90 mm diameter. The percent feed of the yarn was 2, the heater 4 was kept at 230° C temperature and the number of the false-twists was 2,500 TPM. After the pirn building, the bobbin was removed and the pirn was inserted over a dyeing spindle of 80 mm. diameter. Thereafter, the pirn was axially compressed to half size and was placed in a high pressure dyeing machine. The dyeing was carried out at 130° C for 2 hours. The reference stretch recovery characteristic curve of the yarn so prepared is shown in FIG. 16. On the basis of this characteristic curve, an approximate take-up feed characteristic curve such as shown in FIG. 17 was designed and the apparatus of the present invention was adjusted in accordance with the operational programme corresponding to this approximate characteristic curve. The processing conditions were as shown in table 2 below. The stretch recovery characteristic curve of the yarn so processed is shown by a dotted line in FIG. 16, which proves the fact that the yarn processed according to the present invention is provided with uniform stretch recovery regardless of the location of the yarn layer in the pirn configuration.

Table 2

| Period | a | b |
|---|---|---|
| Length in hr. | 13 | 7 |
| Distance between neighbouring pulses in sec. | 210 | 120 |
| Polarity of the pulses | + | + |
| Initial percent take-up feed | 15 | |
| Wound mass of the yarn in gr. | 1000 | |

In the case of this example, the operational part 34C in the arrangement shown in FIG. 8 was kept inoperative.

What is claimed is:

1. Apparatus for taking up a textured false twist, heat set yarn onto a bobbin after false twisting by a false twisting apparatus provided with a feed roller mechanism and a delivery roller mechanism disposed along a yarn passage at a downstream position thereof and a heater and a false twisting spindle disposed along said yarn passage between said feed roller mechanism and said delivery roller mechanism, comprising said taking up apparatus disposed at a position downstream of said delivery roller mechanism, a power transmission mechanism for transmitting driving power from said delivery roller mechanism to said taking-up apparatus, said power transmission mechanism having a speed converter for changing the output of said power transmission mechanism, control means for controlling the conversion ratio between an input and an output of said speed converter according to a predetermined program in which the program pattern is the inversion of the stretch recovery characteristic curve of said yarn when said yarn is wound at a constant speed, to change the percent of stretch recovery due to locations of yarn layers formed by said textured yarn on said bobbin.

2. The apparatus as claimed in claim 1 wherein said input of said speed converter is connected to said delivery roller mechanism and said output thereof is connected to said taking up apparatus.

3. The apparatus as claimed in claim 1 in which said control means includes a pilot shaft mechanically connected to said speed converter for changing said conversion ratio.

4. The apparatus as claimed in claim 3 wherein said speed converter comprises a bevel chain wheel assembly connected to said input of said speed converter, another bevel chain wheel assembly connected to said output of said speed converter, an endless chain running in meshing engagement with said two sets of bevel chain wheel assemblies for transmission of rotation and a pair of pivoted operator arms connected, at their one ends, to said pilot shaft and to said bevel chain wheel assemblies, which operator arms change the rotation transmission ratio between said bevel chain wheel assemblies by their swinging caused by rotation of said pilot shaft.

5. The apparatus as claimed in claim 3 wherein said control means comprises multiple sets of pulse generators and a rotating mechanism selectively connected to one of said pulse generators in order to cause the rotation of said pilot shaft upon receipt of pulse signals generated by said selected one of said pulse generators, the selective connection between said pulse generators and said rotating mechanism being shifted time-functionally.

6. The apparatus as claimed in claim 5 wherein the time-functional shifting of said connection is effectuated by time-limit timers accompanying said respective pulse generators.

7. The apparatus as claimed in claim 5 wherein said driving and controlling means includes three sets of pulse generators.

8. The apparatus as claimed in claim 5 wherein said driving and controlling means includes two sets of pulse generators.

9. The apparatus as claimed in claim 5 wherein said rotating mechanism comprises a ratchet mechanism and a rotary solenoid combined with the former.

10. The apparatus as claimed in claim 9 wherein said rotary solenoid comprises a casing, an electric magnet placed in said casing and a movable disc facing said casing via rolling balls and connected to a disc of said ratchet mechanism by a shaft passing freely through said electric magnet; and the other disc of said ratchet mechanism is connected to said pilot shaft via an output shaft of said rotating mechanism.

11. The apparatus as claimed in claim 5 further comprising a mechanism for resetting the angular position of said pilot shaft.

12. The apparatus as claimed in claim 11 wherein said resetting mechanism comprises an auto-counter connected to said pilot shaft, a motor connected to said pilot shaft in order to rotate same in the direction opposite to normal upon receipt of signal from said auto-counter and clutch mechanisms inserted between said pilot shaft and said rotating mechanism.

* * * * *